US005615558A

United States Patent [19]

Cornell et al.

[11] Patent Number: 5,615,558

[45] Date of Patent: Apr. 1, 1997

[54] OPTICAL COOLING OF SOLIDS

[76] Inventors: Eric A. Cornell, 948 Marine St., Boulder, Colo. 80302; Michael J. Renn, 615 E. 5th Ave., Longmont, Colo. 80501

[21] Appl. No.: 533,656

[22] Filed: Sep. 25, 1995

[51] Int. Cl.[6] ..... F25B 21/00; F25D 23/00

[52] U.S. Cl. ..... 62/56; 62/264; 62/467

[58] Field of Search ..... 62/56, 467, 264, 62/3.1

[56] References Cited

U.S. PATENT DOCUMENTS 4,007,009 2/1977 Wright ..... 250/458 X

FOREIGN PATENT DOCUMENTS 1677459 9/1991 U.S.S.R. ..... 62/3.1

OTHER PUBLICATIONS

Kafri et al., Thermodynamics of Adiabatic Laser Processes Optical Heaters and Refrigerators, Optics Communications, vol. 12, No. 2, pp. 118–122, Oct. 1974.

Gosnell et al., Laser Cooling of Solids, Conference Proceedings, Baltimore Md., May 1995.

Bagnato et al., Laser Deceleration and Velocity Bunching of a Neutral Sodium Beam, J. Opt. Soc. Am. B., vol. 6, No. 11, pp. 2171–2177, Nov. 1989.

Djeu et al., Laser Cooling by Spontaneous Anti–Stokes Scattering, Physical Review Letters, vol. 6, No. 4, pp. 236–239, Jan. 1981.

Berdahl, Galvanomagnetic Radiative Cooling Effect, Conference Proceedings, Stockholm, Sweden, 1986.

Berdahl, Radiantrefrigeration by Semiconductor Diodes, J. Appl. Phys, pp. 1369–1374, Aug. 1985.

Berdahl et al., Negative Luminescence of Semiconductors, Infrared Phys., vol. 29, No. 2–4, pp. 667–672, 1989.

Dousmanis et al., Evidence of Refrigerating Action by Means of Photon Emission in Semiconductor Diodes, Physical Review, vol. 133, No. 1A, pp. A316–A318 Jan. 1964.

Weinstein, Thermodynamic Limitation on the Comversion of Heat Into Light, Journal of the Optical Society of America, vol. 50, No. 6, pp. 597–602, Jun. 1960.

Hansch et al., Cooling of Gases by Laser Radiation, Optics Communications, vol. 13, No. 1, pp. 68–69, Jan. 1975.

*Primary Examiner*—William E. Wayner
*Attorney, Agent, or Firm*—Harris & Burdick

[57] ABSTRACT

A device and method for laser cooling of a solid to extremely low temperature is disclosed, the device including an active cooling structure having a high purity surface passivated direct band gap semiconductor crystal of less than about 3 microns thick and a transparent hemispherical body in optical contact with the crystal. The crystal is itself cooled when illuminated with a laser beam tuned to a frequency no greater than the band gap edge frequency of the crystal. Cooling is caused by emission of photons of higher energy than photons entering the crystal, the additional energy being accounted for by process of absorption of thermal phonons from the crystal lattice.

34 Claims, 3 Drawing Sheets

OPTICAL COOLING OF SOLIDS

FIELD OF THE INVENTION

This invention relates to cooling devices and methods, and, more particularly, relates to devices and methods for cooling solids to extremely low temperatures.

BACKGROUND OF THE INVENTION

Heretofore known means utilized for cooling solids to very low temperatures (–200 C. or lower) all have well understood drawbacks. Cryogenic fluids are messy, expensive, and difficult to contain, regulate and incorporate into automated processes. Sterling cycle pumps are also expensive, are not sufficiently reliable in many application, and cause vibration.

The need for reliable and low cost means for cooling solids to such low temperatures is, however, growing. For instance, infra-red viewers require cooled sensors in order to be able to image purely ambient thermal radiation. Currently, these devices employ closed-cycle refrigerators that is both expensive and bulky, thus making use of such devices impractical in a variety of every-day applications for which they might otherwise be used. Superconductor integrated circuits such as those used in some computers and elsewhere could be more widely employed if the need for expensive cryogenic refrigeration systems used with such circuits could be eliminated.

In the last decade there has been substantial progress in the field of laser cooling of atomic gases. Temperatures as low as a millionth of a degree Kelvin have been obtained, for instance, in a Cesium vapor. A number of different mechanisms have been successfully employed in cooling such vapors. In each the basic idea is the same, an intense beam of monochromatic laser light being directed into the vapor to thereby take advantage of a mechanism internal to the atom to cause it to absorb a photon from the laser beam and then reemit a photon of slightly higher frequency (i.e., higher energy). The net loss of energy from the atom causes the individual atom, and eventually the entire gas of atoms, to slow down, that is, to become colder. These methods for cooling atomic vapors have, however, had very limited industrial applicability, the methods only being effective for extremely low density atomic vapors.

Various theoretical approaches to optically cooling solids have been heretofore suggested. For example, optical refrigeration of diodes by flowing a current into a light-emitting diode and generating photons with greater than eV worth of energy each has been heretofore suggested, but as a practical matter is unlikely to be effective in view of the joule heating associated with electrical current flow.

Other paradigms of optical cooling of media have been theoretically investigated, including sending a low energy photon into a medium and getting a high energy photon out with resultant cooling. However, none have suggested any particular mechanism or device for causing emitted photons from a solid to be of higher energy than photons entering the solid, nor have they confronted the particular technical problems that have seemed to make such theoretical optical approaches to cooling of a solid impractical.

SUMMARY OF THE INVENTION

This invention provides a device and method for cooling solids utilizing laser optics. The device is of solid state construction and can be inexpensively produced. The device includes a crystalline structure which is itself cooled when illuminated with a laser beam of selected frequency by emission of photons of higher energy than photons entering the mechanism, the additional energy being accounted for by process of absorption of thermal phonons from the crystal lattice.

The device includes a high purity semitransparent crystal and means associated with the crystal for reducing nonradiative recombination of photors entering the crystal. The crystal is preferably a semiconductor crystal, and the means for reducing nonradiative recombination includes a transparent body for reducing total internal reflection of light scattered in the semiconductor crystal, the transparent body having an index of refraction matched within selected parameters to the semiconductor crystal and a band gap larger than the band gap of the semiconductor crystal. The transparent body is held in optical contact relative to the semiconductor crystal and is preferably a hemisphere made of either GaP or AlGaAs. Dual hemispheres, one on each side of the semiconductor crystal, are preferred.

The crystal is a thin (less than about 3 microns) direct band gap semiconductor crystal characterized by minimal band tails such as GaAs. A passivating layer or layers of lattice matched material at the crystal, having a larger band gap than the crystal, are provided to inhibit nonradiative recombination, the passivating layers preferably formed of GaInP or AlGaAs.

A laser illuminates the crystal, the laser tuned to a frequency not greater than the band gap edge frequency of the semiconductor crystal.

The method of this invention for cooling a solid includes the step of directing a laser beam having a selected frequency into a solid structure including a high purity semitransparent semiconductor crystal having a defined band gap and band gap edge frequency, the selected frequency of the laser beam being no greater than the band gap edge frequency of the semiconductor crystal. Light from the laser beam scattered at the semiconductor crystal and leaving the solid structure includes photons each having more energy than a photon of the laser beam entering the solid structure. Nonradiative recombination, including that caused by total internal reflection of light scattered in the semiconductor crystal, is reduced by promoting passage of the scattered light from the semiconductor crystal.

It is therefore an object of this invention to provide a device and method for optical cooling of a solid.

It is another object of this invention to provide a device for optical cooling, or laser refrigeration, of a solid that is of solid state construction and can be inexpensively produced.

It is still another object of this invention to provide an optical cooling device wherein the device includes a crystalline structure which is itself cooled when illuminated with a laser beam of selected frequency by emission of photons of higher energy than photons entering the mechanism, the additional energy being accounted for by process of absorption of thermal phonons from the crystal lattice.

It is yet another object of this invention to provide a device which is cooled by illumination with a laser beam of selected frequency, the device including a high purity semitransparent crystal and means associated with the crystal for reducing nonradiative recombination of photons entering the crystal.

It is still another object of this invention to provide an optical cooling device including a semiconductor crystal and a transparent body for reducing total internal reflection of light scattered in the semiconductor crystal, the transparent body having an index of refraction matched within selected parameters to the semiconductor crystal and a band gap larger than the band gap of the semiconductor crystal, the transparent body held in optical contact relative to the semiconductor crystal.

It is still another object of this invention to provide an optical cooling device wherein the active cooling structure is a passivated direct band gap semiconductor having minimal band tails.

It is still another object of this invention to provide a device for cooling solids including a thin film active cooling structure having a high purity semitransparent semiconductor crystal layer and a passivating layer, the semiconductor crystal layer having a defined band gap and band gap edge frequency and the passivating layer characterized by a band gap larger than the band gap of the semiconductor crystal layer, a hemisphere held in optical contact with the active cooling structure, the hemisphere having an index of refraction matched within selected parameters to the semiconductor crystal layer and a band gap larger than the band gap of the semiconductor crystal layer, and a laser adjacent to the active cooling structure and tunable within a selected frequency range, whereby the active cooling structure is illuminated by the laser tuned to a frequency not greater than the band gap edge frequency of the semiconductor crystal layer.

It is yet another object of this invention to provide a method for cooling a solid comprising the step of directing a laser beam having a selected frequency into a solid structure including a high purity semitransparent semiconductor crystal having a defined band gap and band gap edge frequency, the selected frequency of the laser beam being no greater than the band gap edge frequency of the semiconductor crystal, so that light from the laser beam scattered at the semiconductor crystal and leaving the solid structure includes photons each having more energy than a photon of the laser beam entering the solid structure.

It is still another object of this invention to provide a method for optically cooling a solid utilizing laser light shined into a semiconductor crystal including the step of reducing nonradiative recombination, including that caused by total internal reflection of light scattered in the semiconductor crystal, by promoting passage of the scattered light from the semiconductor crystal.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

For all embodiments of the invention hereinafter described, a laser beam is directed into a semi-transparent solid medium, and, by taking advantage of a quantum mechanism internal to the solid, the light that is scattered out is caused to be of higher frequency (i.e., bluer) than the incoming light. There are several mechanisms that can be employed.

Of these, the preferred approach is to use a high purity crystal of a direct band gap semiconductor (i.e., a semiconductor material which exhibits fast radiative recombination rates) with minimal band tails, for instance Gallium Arsenide (GaAs). An incoming laser beam is tuned exactly to the band edge frequency of the semiconductor crystal. Since the thermal equilibration time of the excited carriers is much shorter than the optical requilibration (i.e., recombination) time, the carriers will not recombine until they have redistributed themselves at thermal energies above and below the band edge. Thus, when they do recombine, the emitted photon will have on the average about 2 $k_BT$ more energy than the absorbed photon, where $k_B$ is Boltzmann's constant, and T is the temperature of the semiconductor. The extra energy is absorbed from the crystal's thermal phonons. When the electron falls back down to valence band, while there is a chance that it will reemit the phonon or phonons it has absorbed, it is much more likely it will emit a photon with energy greater than the band gap energy. Another way to look at it is that after each absorption and reemission cycle, the crystal has fewer thermal phonons and is thus colder.

Figure 1A:
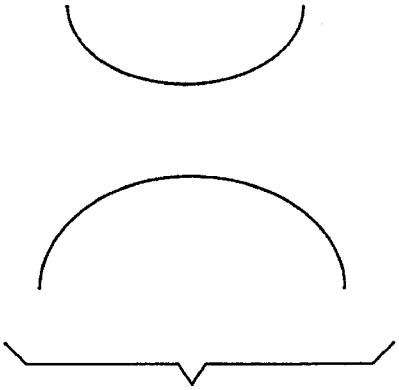
FIGS. 1*a* through 1*d* are diagrams illustrating quantum mechanisms allowing optical cooling of a solid in accord with this invention.

Referring to FIGS. 1*a* through 1*d*, the incoming laser is tuned such that the photons in the laser beam have just enough energy to promote an electron out of the valence band and into the conduction band of the semiconductor (FIG. 1*a*). The promoted electron in the conduction band, and the hole left behind in the valence band, are known as free carriers, or simply carriers.

Figure 1B:
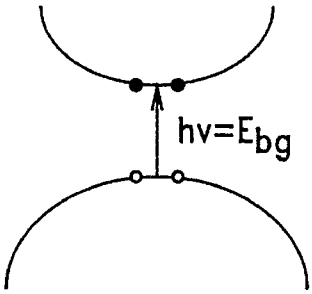
Figure 1C:
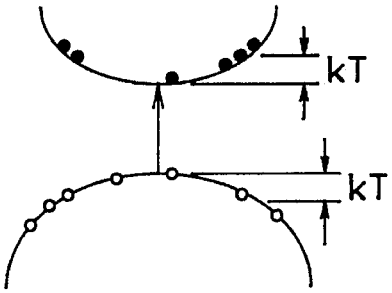

Because the laser photon energy is only barely sufficient to create the carriers, the carriers are initially located at their minimum energy location in the semiconductor bands (FIG. 1*b*, where the electron is at the bottom of the conduction band and the hole is at the top of the valence band). Eventually the electron will fall back down into the valence band, filling a hole (i.e., the electron and the hole recombine), usually, emitting a photon in the process of recombination.

Figure 1D:
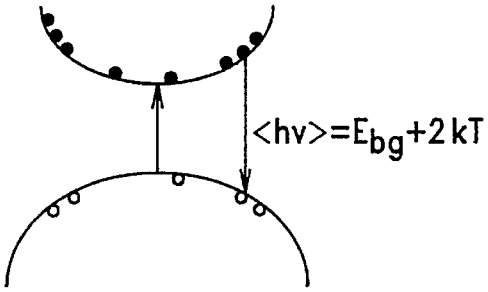

Before the carriers recombine, there is opportunity for them to come into thermal equilibration with the semiconductor's crystal lattice. Basically, the carriers absorb heat out of the lattice and can thus move randomly into higher energy positions in the band (see FIG. 1*c*). When the carriers finally do recombine, the photon they emit has energy equal to the band gap energy plus the extra thermal energy the carriers have acquired (FIG. 1*d*). There is a net cooling effect because the photon that is reemitted has higher energy than the photon that was initially absorbed, the additional energy having been extracted from the crystal lattice of the semiconductor.

Figure 2:
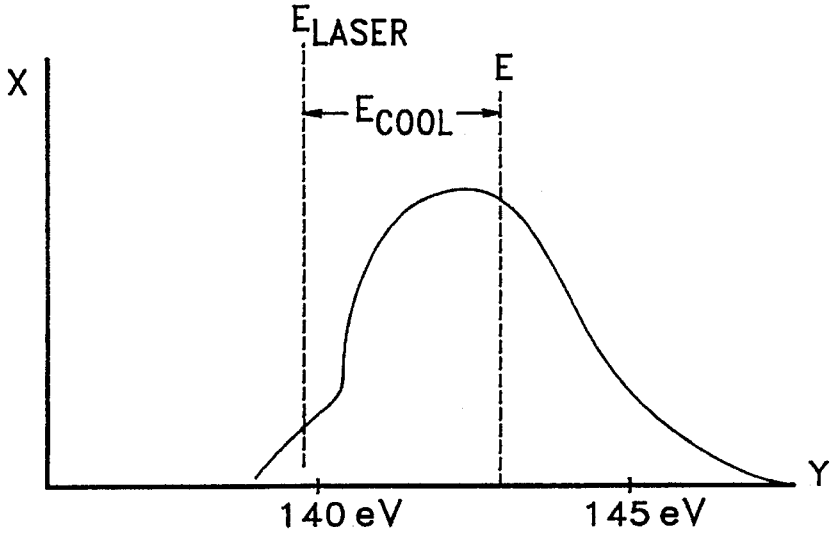
FIG. 2 is a graphical representation of expected cooling utilizing this invention.

Referring to FIG. 2, where the x axis is fluorescence and the y axis is photon energy, the cooling rate of the semiconductor crystal is illustrated. Since the mean scattered photon energy E of photons reemitted from an appropriate semiconductor crystal (in this case GaAs) having a laser beam shined thereinto does not depend on the energy of the incoming laser photons ($E_{laser}$), if the laser beam is tuned to a lower energy than the mean scattered photon energy, cooling of the crystal will result (on the average, each photon absorbed by the semiconductor crystal and then reemitted cools the crystal by $E-E_{laser}$ (i.e., $E_{cool}$).

While increases in cooling power per photon can be achieved by decreasing the energy of the incoming laser, because the cooling power per photon is simply the difference between the incoming laser photon energy and the mean scattered photon energy, there is a practical lower limit to laser photon energy. As the laser photon energy becomes comparable to or even slightly lower than the band gap energy, the amount of laser power absorbed from the laser by the crystal drops precipitously. For lower photon energy one may get more cooling per absorbed photon, but the overall cooling power may decrease because the laser light will pass through the crystal without being absorbed at all.

As the cooling semiconductor crystal structure's temperature decreases towards its ultimate operating temperature, it is necessary to adjust the laser wavelength as the structure cools because the band-gap energy (for example of GaAs) is temperature-dependent. This can be accomplished by changing the input current driving the laser array.

There are a number of technical difficulties associated with such an optical cooling approach. Each photon in the laser beam represents perhaps 1.5 eV of energy, but each scattering process removes perhaps as little as 50 meV of energy. Thus a single episode of nonradiative recombination, in which a photon is completely absorbed rather than reemitted, provides enough heating to undo the cooling provided by 30 scattering processes. Nonradiative recombination must therefore be reduced substantially. There are several basic technical difficulties described hereinafter which are related to this problem.

The auger process allows nonradiative recombination. The rate of auger processes goes as the cube of the density of free carriers. On the other hand, the radiative recombination rate goes only as the square of the density of free carriers. The auger process can thus be made insignificant relative to the desirable radiative recombination rate by keeping the density of free carriers low. In practice, this means using an undoped semiconductor, and observing a limit on the cooling rate attempted.

In Gallium Arsenide, for example, a density of perhaps $10^{16}$ carriers/cc is acceptable, which will result in cooling powers of several watts/cc at 200K. At a density of $2\times10^{17}$ carriers/cc in a wafer two microns thick and one millimeter square, 100 milliwatts of cooling power could be generated at 200K.

Reabsorption also improves the opportunity for nonradiative recombination. Since the incoming photons are at or below the band gap edge frequency, the semiconductor is nearly transparent to them. But after the photons have scattered their energy is above the band gap and the they are strongly absorbed by the crystal. The photons will be repeatedly emitted and reabsorbed, and will eventually defuse to the edge of the crystal, but each reabsorption is an opportunity for nonradiative recombination to occur. Moreover, every occasion of internal reflection of a photon in the semiconductor exacerbates the problem. Avoidance of this problem dictates, among other things, the use of a very thin semiconductor wafer (on the order of three microns or less).

Finally, surface recombination provides another opportunity for nonradiative recombination. In very pure semiconductors, the probability for nonradiative recombination in the bulk is quite low. But at the surface, the band levels are very perturbed and nonradiative recombination becomes quite likely. Since a thin wafer is used to avoid reabsorption, the mobility of the excited carriers may well be great enough to carry them to a surface before they recombine. The solution, as described herein, is to sandwich the active semiconductor crystal layer between two wafers of a lattice matched material with a larger band gap (i.e., to passivate the crystal's surfaces). Because the band gap is large in the sandwiching wafers, photons will propagate more freely out into the ambient (which is typically a vacuum). The free carriers moving through the active material will be reflected by the interface back into the active material.

A specific example of a passivated active cooling structure in accord with the foregoing would be a thin film wafer composed of a layer of GaAs between about 0.1 and 3 microns thick (preferably between about 0.5 and 2 microns), having a layer of GaInP or AlGaAs on opposite surfaces thereof. The sandwiching wafers can be made somewhat thicker to provide physical support for the very thin wafer of GaAs. The three layers could be grown by metalo-organic chemical vapor deposition (MOCVD) or molecular beam epitaxy to insure that the interface between the layers is free of surface states that might trap free carriers thus allowing nonradiative recombination. Other semitransparent semiconductor crystal materials could be utilized so long as they exhibit a relatively fast radiative recombination rate, have minimal band tails, and are amenable to being passivated as described herein. The material utilized must exhibit high spatial uniformity such that the variation in the band gap energy across the active volume of the material is less than or equal to the desired $k_BT$ where T is the lowest desired temperature of operation. Radiative recombination efficiency (a function of the desired operating temperature T and the band gap energy $E_{bg}$) of the selected material required to enable efficient refrigeration must of course be greater than 1 ($E_{bg}/T$), and is preferably greater than about 4 ($E_{bg}/T$) at optimized optical injection levels. Moreover, complimentary materials comprising the remainder of the device must be available that maintain band gap and index of refraction relationships to the semiconductor crystal as set forth herein.

As described hereinabove, nonradiative carrier recombination must be much lower than the rate of radiative carrier recombination (efficient cooling requiring that the radiative rate be at least 100 times larger than the nonradiative rate at a crystal temperature of 150K and an incoming photon energy of 1.5 eV). This requirement puts firm upper and lower limits on the density of free carriers that can be present in the cooling region. As discussed, surface recombination can be minimized by passivating the surface of the active semiconductor crystal material. Current state of the art for surface passivation (for GaAs using $GaInP_2$, for example) yields an effective wall recombination velocity around $v_{wall}=10$ cm/sec. That is, the rate of wall recombination in a thin wafer, per unit volume of illuminated sample, is $$\gamma_{wall}=2nv_{wall}/d \quad \text{(i)}$$

where d is the thickness of the sample in centimeters and n is the carrier density in carriers per cubic centimeter.

The radiative recombination rate is given by $$\gamma_{radiative}=(7.5\times10^{-10})n^2 \quad \text{(ii)}$$

Comparing equations (i) and (ii), if a carrier density larger than $n=10^{16}$ (for an active cooling structure sample thickness of d=2 microns) is maintained, the wall recombination rate will be at least a factor of 100 less than the radiative recombination rate.

The rate of auger recombination in GaAs is $$\gamma_{auger}=(7\times10^{-31})n^3 \quad \text{(iii)}$$

Comparing equations (ii) and (iii), we see that as long as the carrier density is less than $n=10^{19}$, the auger rate will be at least a factor of 100 less than the radiative recombination rate, as required.

Upper and lower limits to the allowable density of free carriers in the active material depend on the quality of the surface passivation and on the particular semiconductor used as the active material. The density of carriers is of course related to the intensity and wavelength of the cooling laser beam.

Regarding the problem of internal reflection (which enhances the opportunity for nonradiative recombination by multiplying reabsorption occurrences as discussed above), semiconductor crystals usually have a very high index of refraction (about 3.5 for GaAs for instance). This means that a light ray approaching the semiconductor crystal's surface from the inside at an angle greater than 13° from the perpendicular will be reflected back into the material. Thirteen degrees or less from the perpendicular encompasses a relatively small solid angle, so there is little chance that a photon emitted at a random angle will escape from the crystal. It could thus be reflected inward to be absorbed and reemitted many times, finally being absorbed without reemission and depositing its energy into the crystal via a nonradiative recombination (known as total internal reflection).

In this invention, the problem of total internal reflection is resolved by placing the active cooling structure material, in the form of a thin wafer of surface-passivated GaAs, in optical contact with the highly-polished flat side of a transparent hemisphere serving as a body for readily allowing passage of scattered luminescent light out of the active material. The hemisphere is made of a material with a band gap considerably larger than the active material, so it is completely nonabsorbent to the laser and scattered photons. The material also must have an index of refraction similar to the active material (for GaAs, AlGaAs or GaP meets these requirements). Photons leaving the GaAs will encounter no change in index of refraction as they enter the hemisphere, and therefore will not reflect. If the cooling laser is focussed such that it only illuminates a small portion of the active material near the center of the face of the hemisphere, all the light that scatters out into the hemisphere will encounter the curved surface of the hemisphere at an angle of incidence near perpendicular, and will thus not undergo total internal reflection (i.e., will allow passage of the scattered light out of the cooling structure). The diameter of the illuminated spot at the center of the flat surface should be less than one tenth the diameter of the hemisphere. This will ensure that all outgoing light rays encounter the surface of the hemisphere at an angle less than 6°. As described, this system also accommodates pointing of the incoming laser beam into the active material at a shallow angle thereby increasing the path length therethrough and opportunity for photon absorption. Increased efficiency can be obtained by coating the curved surface of the hemisphere with an antireflection coating (for example, with thorium dioxide).

Referring now to FIGS. 3 through 7, semiconductor material requirements, device geometry, and Fump laser requirements of the best mode so far devised for implementation of the preferred approach to laser refrigeration in the solid state as discussed above will be described. Active cooling structure 11 may be cooled to 70K. or lower with the described laser 13 tuning procedure and may be used to refrigerate a high $T_c$ superconductor integrated circuit, the imaging plane of a high-sensitivity camera such as an infra-red detecting camera, or the like.

Figure 3:
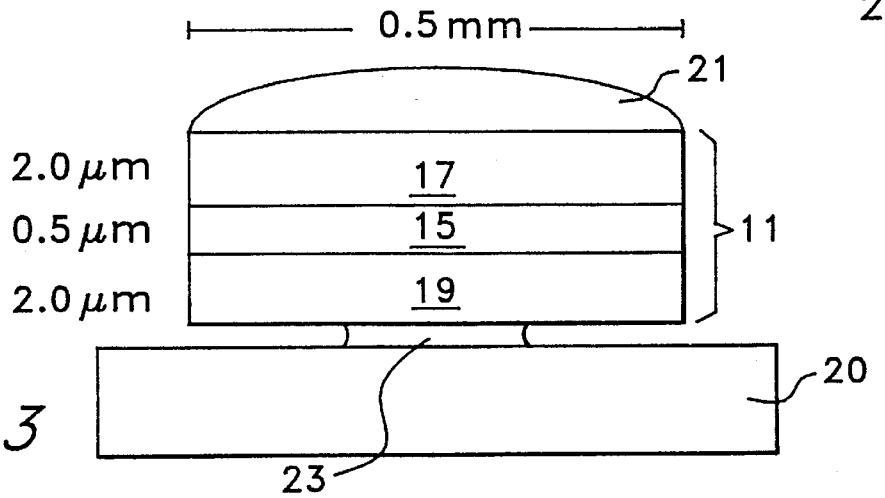
FIG. 3 is a sectional illustration of the active cooling structure of this invention.
Figure 6A:
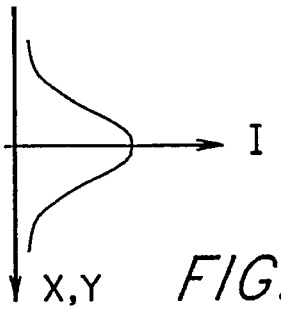
FIGS. 6*a* and 6*b* are graphical representations of beam intensity profiles of the laser beam utilized in the cooling device and method of this invention.
Figure 6B:
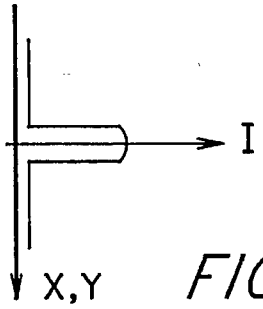

Active cooling structure 11, including semitransparent semiconductor crystal layer 15 and passivating layers 17 and 19, is a thin film wafer grown using standard MBE or MOCVD techniques and having the heterostructure configuration shown in FIG. 3 where the wafer is shown attached to substrate 20. Black wax 21 is used to protect and support the wafer during epitaxial liftoff. Layers 17, 15 and 19 are made of $GaInP_2$ (about 2 microns), GaAs (about 0.5 microns), and $GaInP_2$ (about 2 microns), respectively. Fourth layer 23, made of $Al_xGa_{1-x}As$, with x between 0.5 and 1.0, is included to allow epitaxial liftoff of the actual heterostructure from growth substrate 20.

The wafer materials must be of very high purity and the surface passivation of the active GaAs layer must be very good. Specifically, GaAs layer 15 must have a radiative recombination coefficient of greatest than about $2\times10^{-10}$ $cm^3s^{-1}$ and an auger recombination coefficient of less than about $2\times10^{-30}$ $cm^6s^{-1}$. The surface passivation must be sufficient to reduce the surface velocity to less than about 10 cm/s. All layers 15, 17 and 19 are undoped with allowable residual or background doping less than about $10^{16}$ $cm^{-3}$. Passivation layers 17 and 19 could also be made of AlGaAs if it is undoped and the surface velocity satisfies the above requirement.

Figure 4:
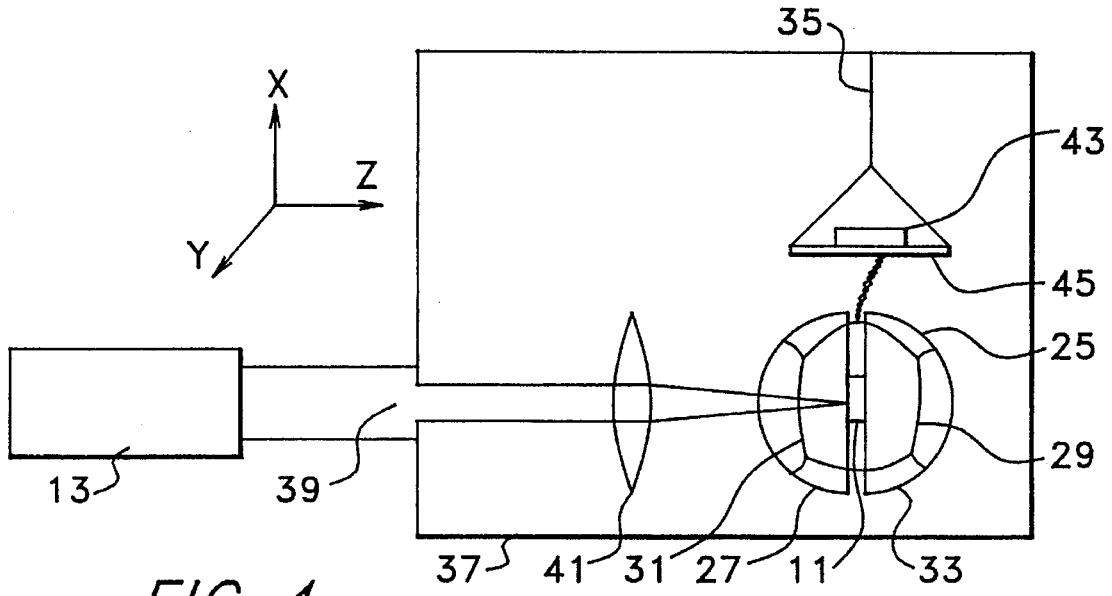
FIG. 4 is an illustration of the overall cooling device of this invention.
Figure 5:
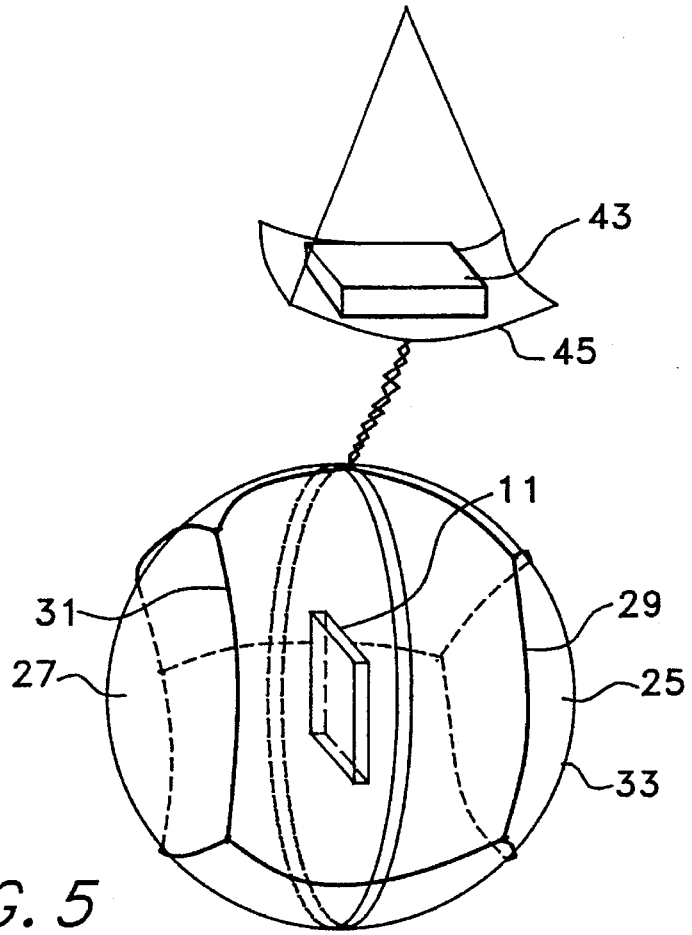
FIG. 5 is an illustration of a portion of the cooling device of this invention in thermal contact with a device to be cooled.

A complete system, or device, for optical cooling (or refrigeration) of solids is illustrated in FIGS. 4 and 5. It includes active cooling structure 11 sandwiched between two index matching hemispheres 25 and 27. Hemispheres 25 and 27 and structure 11 are held together by means of two gold wire harnesses 29 and 31. Each harness wraps around a hemisphere and the harnesses are fastened together by twisting together the loose ends of the harnesses. The loose ends are twisted to sufficient pressure so that optical contacting between structure 11 and hemispheres 25 and 27 is observed (the contact region between the hemispheres and structure 11 will appear black when optical contact is established). The tension on the wires then maintains the optical contact. Cooling device 33 thus assembled is thermally isolated by suspension of the device from thin wire 35 in vacuum chamber 37.

Hemispheres 25 and 27 are made of either GaP or AlGaAs with the requirement that the bulk absorption coefficient be less than about 0.001 $cm^{-1}$ between 810 nm and 880 nm. Other materials may be substituted if this absorption criterion is met and the refractive index is between 3.2 and 3.8 (less well matched materials, i.e., having a lower refractive index, could be utilized if other structural adjustments are made). The hemispheres' surface quality is less than about 40–20 scratch and dig. The radius of the curved side is about 5.0 mm. The curved surface should be antireflection coated (using thorium dioxide for example) for wavelengths between 810 nm and 880 nm with the reflectance less than 0.5%. The flat side must be planar to less than about 632.8 nm/8.

Laser 13 is a cw laser capable of tuning from 840 nm to 880 nm and sourcing 1 Watt in a $TEM_{00}$ mode. The Gaussian beam profile (FIG. 6*a*) is converted to an approximately square intensity profile (FIG. 6*b*) by passing the beam through iris 39. The square beam is then imaged by lens 41 and index matching hemisphere 27 to a 40 micron diameter spot on structure 11. The laser beam may be aimed at an angle (in the Y axis in FIG. 4) between about 70° and 80° from perpendicular to the surface of structure 11 to effectively lengthen the path length of the beam through structure 11. With the laser tuned to the band edge frequency of the active GaAs layer 15, approximately 10% of the incident laser light is absorbed and a very large fraction reemitted from structure 11 as luminescence.

The luminescent light emitted from structure 11 will have a higher energy than the incident light. As set forth above, the energy shift is caused by the extraction of heat from the crystal lattice of semiconductor crystal layer 15. As a result the wafer becomes colder and in turn cools hemispheres 25 and 27.

Figure 7:
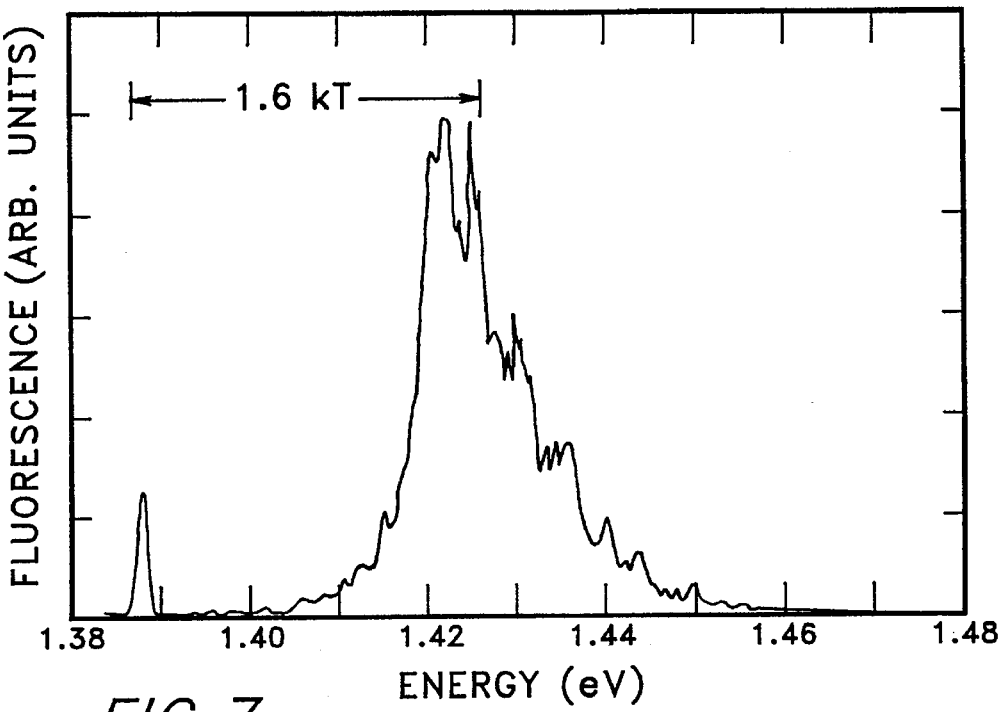
FIG. 7 is a graphical illustration of results of a proper tuning of the laser utilized in the device of this invention for cooling a solid.

As structure 11 cools, the band gap of GaAs layer 15 becomes larger and the laser wavelength must be tuned to shorter wavelengths to maintain a constant carrier excitation rate. This is most easily done by monitoring the luminescence spectrum with a grating spectrum analyzer and shifting the laser wavelength so that it coincides with the band edge frequency. The blue-shift of the luminescence can be calibrated to indicate the temperature of the sample as it cools. The tuning procedure can be automated by recording the temperature versus time behavior of device 43 being cooled during a calibration run and then scanning the laser wavelength appropriately in time. A proper tuning of the laser is shown in FIG. 7. At the tuning indicated in FIG. 7, the average energy shift between the laser and the luminescence is 1.6 $k_BT$. With an external radiative efficiency of 98%, the cooling power generated is 1% of the absorbed laser power.

Dual hemispheres are utilized to further limit internal reflection and thus the increased probability of direct transformation of incident or luminescent photons into heat. This process becomes more and more likely with each successive absorption and reemission of photons. By use of dual hemispheres, the average path length required for the photons to leave the active material is greatly reduced (i.e., by greatly reducing the likelihood or internal reflection at either surface of structure 11), thereby reducing the likelihood of reabsorption before the photons can escape into index matched hemispheres 25 or 27 and therethrough into the vacuum.

Device 43 to be cooled is attached to the gold wires holding hemispheres 25 and 27 together (see FIGS. 4 and 5). Gold wires provide excellent thermal conductivity, allowing heat to flow from device 43 to the active cooling structure 11. Clean, unstained gold foil 45 shades the device from the heating effect of the scattered light.

Where AlGaAs is to be utilized for hemispheres 25 and 27, the wafer material must be grown observing special procedures. The basic growth technique is called Halide Transport Vapor Phase Epitaxy, a well known process. Care must be taken, however, to preserve the purity of the final product, if the desired optical transparency is to be maintained. After passing over the molten gases, the chlorine gas should encounter only quartz tubing, and the growth substrate itself. This prevents the acquisition of impurities, and also minimizes premature plating out of the AlGaAs in the quartz reactor chamber. The molten metals should be heated in pure graphite boats, again to avoid impurities. The initial reagents used should be of the same quality used in high-quality MOCVD semiconductor growth.

Precautions should be observed to prevent growth of AlGaAs in the quartz tubing, for instance in the exhaust system. Otherwise clogging could occur quickly, compared to the very long duration (about 40 hours) growth runs required to obtain wafers of the desired thickness. Clean practices must thus be observed, even in the exhaust system, to prevent there being a nucleus at which deposition can begin.

After the AlGaAs wafer is grown, the original GaAs starter substrate is etched or polished off, and the AlGaAs is first rough-hewn and then polished into a hemisphere using completely conventional lens making techniques. Some surface oxidation of the AlGaAs occurs during handling, but the thin (perhaps 1000 Angstroms) layer of oxide does not impair the optical properties.

Alternative designs of the above system could be utilized. For example, only a single hemisphere (hemisphere 27 facing laser 13) could be utilized. In such case the opposite surface of structure 11 is coated with a high-reflectance coating (for example, a multilayer quarter-wave stack alternating magnesium fluoride with titanium dioxide) to prevent light from leaking onto and heating the device to be cooled. The device to be cooled would be affixed directly to the back of the high-reflectance coating. Structure 11 can be affixed to the flat surface of the hemisphere simply by surface tension, or a thin layer of nonabsorbent glue could be used.

For use with a single hemisphere, the laser beam should encounter the active superconductor crystal material at a shallow angle. The light which is not initially absorbed passes through the material, reflects off the high-reflectance coating, and passes back through the material a second time. By coming in at shallow angle and passing twice through the material, the laser beam gets a relatively long path through the active material (about 10 microns).

Moreover, the entire system of this invention could be surrounded by a vacuum shield to provide insulation. The vacuum chamber could be divided to provide a separate chamber for the laser (an array of high-efficiency laser diodes, for example). In this case, the inner surface of the laser chamber is painted a light-absorbing color. The outer surfaces of the laser chamber is exposed to the open air and can be kept near room-temperature either by natural convection or by forced air cooling. The laser could also be mounted just outside the vacuum chamber, with the light shining in through a vacuum-tight window.

Other approaches to achieve emission of photons from a solid structure having energy in excess of the energy of photons entering the structure could be utilized while employing many of the solutions discussed hereinabove to problems of nonradiative recombination (surface passivation and the use of the hemispherical transparent bodies). For example, using a high purity crystal of a direct band gap semiconductor, for instance Gallium Arsenide, the incoming laser beam is set to a frequency just a little too low to be absorbed (i.e., the energy of each photon is slightly smaller than the band gap energy in the semiconductor). Most of the photons will simply pass through the semiconductor crystal. These may be reflected with mirrors to pass through the sample many times. There will be some chance, however, for the photons to undergo phonon-assisted absorption.

By way of further example, instead of using a semiconductor, one could cool a very high purity insulating crystal that has a low concentration of a certain sort of imperfection sites. These imperfection sites will appear as thin lines in the absorption spectrum of the crystal. The laser would then be tuned somewhat red of the center of an absorption line. Under these circumstances, during a photon scattering process a phonon is more likely to be absorbed than emitted because the phonon absorption brings the process closer to resonance.

What is claimed is:

1. A device which is cooled by illumination with a laser beam of selected frequency, said device comprising:

a high purity semitransparent crystal; and means associated with said crystal for reducing nonradiative recombination of photons entering said crystal.

2. The device of claim 1 wherein said crystal is a semiconductor crystal and wherein said means for reducing nonradiative recombination includes a transparent body for reducing total internal reflection of light scattered in said semiconductor crystal, said transparent body having an index of refraction matched within selected parameters to said semiconductor crystal and a band gap larger than the band gap of said semiconductor crystal, said transparent body held in optical contact relative to said semiconductor crystal.

3. The device of claim 2 wherein said transparent body is made of material having a bulk absorption coefficient of less than about 0.001 $cm^{-1}$.

4. The device of claim 2 wherein said semiconductor crystal is GaAs and wherein said transparent body is made of material having a refractive index of between about 2.5 and 3.8.

5. The device of claim 2 wherein said transparent body has a curved surface spaced from said semiconductor crystal, said transparent body having reflectance of less than about 0.5% at said curved surface.

6. The device of claim 1 wherein said crystal is a direct band gap semiconductor crystal characterized by minimal band tails and high spatial uniformity.

7. The device of claim 1 wherein said means for reducing nonradiative recombination includes a passivating layer of lattice matched material at said crystal having a larger band gap than said crystal.

8. The device of claim 7 wherein said crystal and material used for said passivating layer have residual doping no greater than about $10^{16}$ $cm^{-3}$.

9. The device of claim 7 wherein said passivating layer is of material sufficient to reduce surface velocity to less than about 10 cm/s.

10. The device of claim 1 wherein said crystal is an insulating crystal having a low concentration of imperfection sites, the illuminating laser beam being tuned to a frequency lower than identified absorption line located in the absorption spectrum of said insulating crystal corresponding to said imperfection sites.

11. The device of claim 1 wherein said crystal has an auger recombination coefficient less than about $2\times10^{-30}$ $cm^6s^{-1}$.

12. The device of claim 1 wherein said crystal has a radiative recombination coefficient greater than about $2\times10^{-10}$ $cm^3s^{-1}$.

13. The device of claim 1 wherein said crystal is GaAs having a thickness of less that about 2 microns and is illuminated so that a free carrier density per cubic centimeter of between about $10^{16}$ and $10^{19}$ is exhibited.

14. A device for cooling solids comprising:

a thin film active cooling structure including a high purity semitransparent semiconductor crystal layer and a passivating layer, said semiconductor crystal layer having a defined band gap and band gap edge frequency and said passivating layer characterized by a band gap larger than said band gap of said semiconductor crystal layer;

a first hemisphere held in optical contact with said active cooling structure, said first hemisphere having an index of refraction matched within selected parameters to said semiconductor crystal layer and a band gap larger than said band gap of said semiconductor crystal layer; and a laser adjacent to said active cooling structure and tunable within a selected frequency range, whereby said active cooling structure is illuminated by said laser tuned to a frequency not greater than said band gap edge frequency of said semiconductor crystal layer.

15. The device of claim 14 further comprising means for thermally associating said active cooling structure with a solid article to be cooled.

16. The device of claim 14 further comprising a lens for focussing laser light from said laser to a selected location at a surface of said active cooling structure.

17. The device of claim 14 further comprising an iris for converting laser light from said laser from a Gaussian beam profile to a square intensity profile.

18. The device of claim 14 wherein said passivating layer is a first passivating layer, said device further comprising a second passivating layer, said semiconductor crystal layer being between said passivating layers.

19. The device of claim 14 wherein said semiconductor crystal layer is formed of GaAs.

20. The device of claim 19 wherein said first hemisphere is formed of AlGaAs or GaP.

21. The device of claim 19 wherein said passivating layer is formed of $GaInP_2$ or AlGaAs.

22. The device of claim 14 further comprising a vacuum container having said active cooling structure and said hemisphere therein.

23. The device of claim 14 wherein said first hemisphere has an antireflection coating at a curved surface thereof.

24. The device of claim 14 further comprising a second hemisphere held in optical contact with said active cooling structure, said second hemisphere having an index of refraction matched within selected parameters to said semiconductor crystal layer and a band gap larger than said band gap of said semiconductor crystal layer.

25. A method for cooling a solid comprising the step of directing a laser beam having a selected frequency into a solid structure including a high purity semitransparent semiconductor crystal having a defined band gap and band gap edge frequency, said selected frequency of said laser beam being no greater than said band gap edge frequency of said semiconductor crystal, so that light from said laser beam scattered at said semiconductor crystal and leaving said solid structure includes photons each having more energy than a photon of said laser beam entering said solid structure.

26. The method of claim 25 further comprising the step of reducing total internal reflection of light scattered in said semiconductor crystal by promoting passage of said scattered light from said semiconductor crystal.

27. The method of claim 26 wherein the step of reducing total internal reflection includes positioning a flat face of a hemisphere in optical contact with said solid structure, said hemisphere having an index of refraction matched within selected parameters to said semiconductor crystal and having a band gap larger than said band gap of said semiconductor crystal.

28. The method of claim 27 wherein said laser beam is directed to a spot at said semiconductor crystal corresponding to the center of said face of said hemisphere.

29. The method of claim 28 wherein said spot has a diameter less than one-tenth of the diameter of said face of said hemisphere.

30. The method of claim 25 further comprising the step of passivating a surface of said semiconductor crystal utilizing material with a larger band gap than said band gap of said semiconductor crystal.

31. The method of claim 25 wherein said selected laser beam frequency is slightly lower than said band gap edge frequency of said semiconductor crystal.

32. The method of claim 25 wherein said selected laser beam frequency is substantially the same as said band gap edge frequency of said semiconductor crystal.

33. The method of claim 25 wherein said laser beam is directed into said solid structure at a path angle selected to maximize path length through said semiconductor crystal.

34. The method of claim 25 further comprising the step of thermally associating an article to be cooled with said solid structure.

* * * * *